US006213595B1

(12) United States Patent
Anagnostopoulos et al.

(10) Patent No.: US 6,213,595 B1
(45) **Date of Patent: *Apr. 10, 2001**

(54) CONTINUOUS INK JET PRINT HEAD HAVING POWER-ADJUSTABLE SEGMENTED HEATERS

(75) Inventors: Constantine N. Anagnostopoulos, Mendon; James M. Chwalek, Pittsford; Gilbert A. Hawkins, Mendon, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/221,256

(22) Filed: Dec. 28, 1998

(51) Int. Cl.[7] ..... B41J 2/105
(52) U.S. Cl. ..... 347/82
(58) Field of Search ..... ; 347/75, 77, 82; 239/4, 102.01; B41J 2/02, 2/09

(56) References Cited

U.S. PATENT DOCUMENTS

| | | | |
|---|---|---|---|
| 1,941,001 | 12/1933 | Hansell | 347/75 |
| 3,287,734 | 11/1966 | Kazan | 347/75 |
| 3,709,432 | 1/1973 | Robertson | 347/75 |
| 3,878,519 | 4/1975 | Eaton | 347/75 |
| 3,893,623 | 7/1975 | Toupin | 347/75 |
| 4,070,679 | 1/1978 | Fan et al. | 347/75 |
| 4,283,730 | 8/1981 | Graf | 347/75 |
| 4,658,269 | 4/1987 | Rezanka | 347/75 |
| 5,521,621 | 5/1996 | Endo et al. | 347/75 |
| 5,966,154 * | 10/1999 | Deboer | 347/82 |
| 6,019,457 * | 2/2000 | Silverbrook | 347/65 |
| 6,022,099 * | 2/2000 | Chwalek et al. | 347/57 |

FOREIGN PATENT DOCUMENTS

| | | |
|---|---|---|
| 0 856 403 | 8/1998 | (EP) . |
| 2 041 831 | 9/1980 | (GB) . |
| 635185 | 2/1962 | (IT) . |
| 56-21866 | 2/1981 | (JP) . |
| 59-073964 | 4/1984 | (JP) . |
| 6-064161 | 3/1994 | (JP) . |

* cited by examiner

*Primary Examiner*—David F. Yockey
(74) *Attorney, Agent, or Firm*—Milton S. Sales

(57) ABSTRACT

Apparatus for controlling ink in a continuous ink jet printer in which a continuous stream of ink is emitted from a nozzle includes a nozzle bore to establish a continuous stream of ink; a heater having a plurality of selectively independently actuated sections which are positioned along respectively different portions of the nozzle bore; a variable power source for the heater sections; and an actuator adapted to selectively activate none, one, or a plurality of said heater sections with an adjustable amount of power such that actuation of heater sections associated with only a portion of the entire nozzle bore perimeter produces an asymmetric application of heat to the stream to control the direction and the amount of deflection of the stream as a function of the amount of power of the activated heater sections.

8 Claims, 6 Drawing Sheets

CONTINUOUS INK JET PRINT HEAD HAVING POWER-ADJUSTABLE SEGMENTED HEATERS

CROSS REFERENCE TO RELATED APPLICATIONS

Reference is made to commonly assigned, U.S. patent applications Ser. No. 08/954,317 entitled CONTINUOUS INK JET PRINTER WITH ASYMMETRIC HEATING DROP DEFLECTION filed in the names of Chwalek, Jeanmaire, and Anagnostopooulos on Oct. 17, 1997, now U.S. Pat. No. 6,079,821, and our Ser. No. 09/221,342 entitled CONTINUOUS INK JET PRINT HEAD HAVING MULTI-SEGMENT HEATERS filed on Dec. 28, 1998.

FIELD OF THE INVENTION

This invention relates generally to the field of digitally controlled printing devices, and in particular to continuous ink jet print heads which integrate multiple nozzles on a single substrate and in which the breakup of a liquid ink stream into droplets is caused by a periodic disturbance of the liquid ink stream.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical printing presses, even though this conventional method requires very expensive setup and is seldom commercially viable unless a few thousand eopies of a particular page are to be printed. Thus, there is a need for improved digitally controlled printing systems, for example, being able to produce high quality color images at a high-speed and low cost, using standard paper.

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop on demand ink jet. Continuous ink jet printing dates back to at least 1929. See U.S. Pat. No. 1,941,001 to Hansell.

Conventional continuous ink jet utilizes electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are fire to strike the recording medium. U.S. Pat. No. 3,878,519, which issued to Eaton in 1974, discloses a method and apparatus for synchronizing droplet formation in a liquid stream using electrostatic deflection by a charging tunnel and deflection plates.

U.K. Patent Application GB 2 041 831A discloses a mechanism in which a deflector steers an ink jet by the Coanda (wall attachment) effect. The degree of deflection can be varied by moving the position of the deflector or by changing the amplitude of perturbations in the jet.

In commonly assigned, co-pending U.S. patent application Ser. No. 08/954,317 entitled CONTINUOUS INK JET PRINTER WITH ASYMMETRIC HEATING DROP DEFLECTION filed in the names of Chwalek, Jeanmaire, and Anagnostopoulos on Oct. 17, 1997, now U.S. Pat. No. 6,079,891, an ink jet printer includes a delivery channel for pressurized ink to establish a continuous flow of ink in a stream flowing from a nozzle bore. A heater having a selectively-actuated section associated with only a portion of the nozzle bore perimeter causes the stream to break up into a plurality of droplets at a position spaced from the heater. Actuation of the heater section produces an asymmetric application of heat to the stream to control the direction of the stream between a print direction and a non-print direction.

It was also disclosed in the above-cited co-pending application that, using semiconductor VLSI fabrication processes and equipment, and by incorporating addressing and driving circuits on the same silicon substrate as the nozzles, a dense linear allay of nozzles can be produced. Such arrays can be many inches long and contain thousands of nozzles, thus eliminating the need to scan the print head across the page. In addition, inkjet printers may contain multiple arrays, all of which may be located on the same silicon substrate. Each array could then emit a different color ink. Full width and full color ink jet printers can thus be manufactured, which can print at high speeds and produce high quality color prints.

DISCLOSURE OF THE INVENTION

In graphic arts printing systems it is required that the droplets land extremely accurately on the specified locations, because of the high quality images expected from such systems. Many factors influence drop placement, such as air turbulence or non-uniform air currents between the print head and the receiver, varying resistance of the heaters or other manufacturing defects that affect droplet deflection.

It is therefore desirable to compensate for droplet placement errors. Such methods may include elimination of turbulence and more uniform air currents, higher velocity drops, more uniform heater resistance, etc.

Accordingly, it is a feature of the present invention to provide apparatus for controlling ink in a continuous ink jet printer in which a continuous stream of ink is emitted from a nozzle. The apparatus includes a nozzle bore to establish a continuous stream of ink, a heater having a plurality of selectively independently actuated sections which are positioned along respectively different portions of the nozzle bore; a variable power source for the heater sections; and an actuator adapted to selectively activate none, one, or a plurality of said heater sections with an adjustable amount of power such that actuation of heater sections associated with only a portion of the entire nozzle bore perimeter produces an asymmetric application of heat to the stream to control the direction and the amount of deflection of the stream as a function of the amount of power of the activated heater sections.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
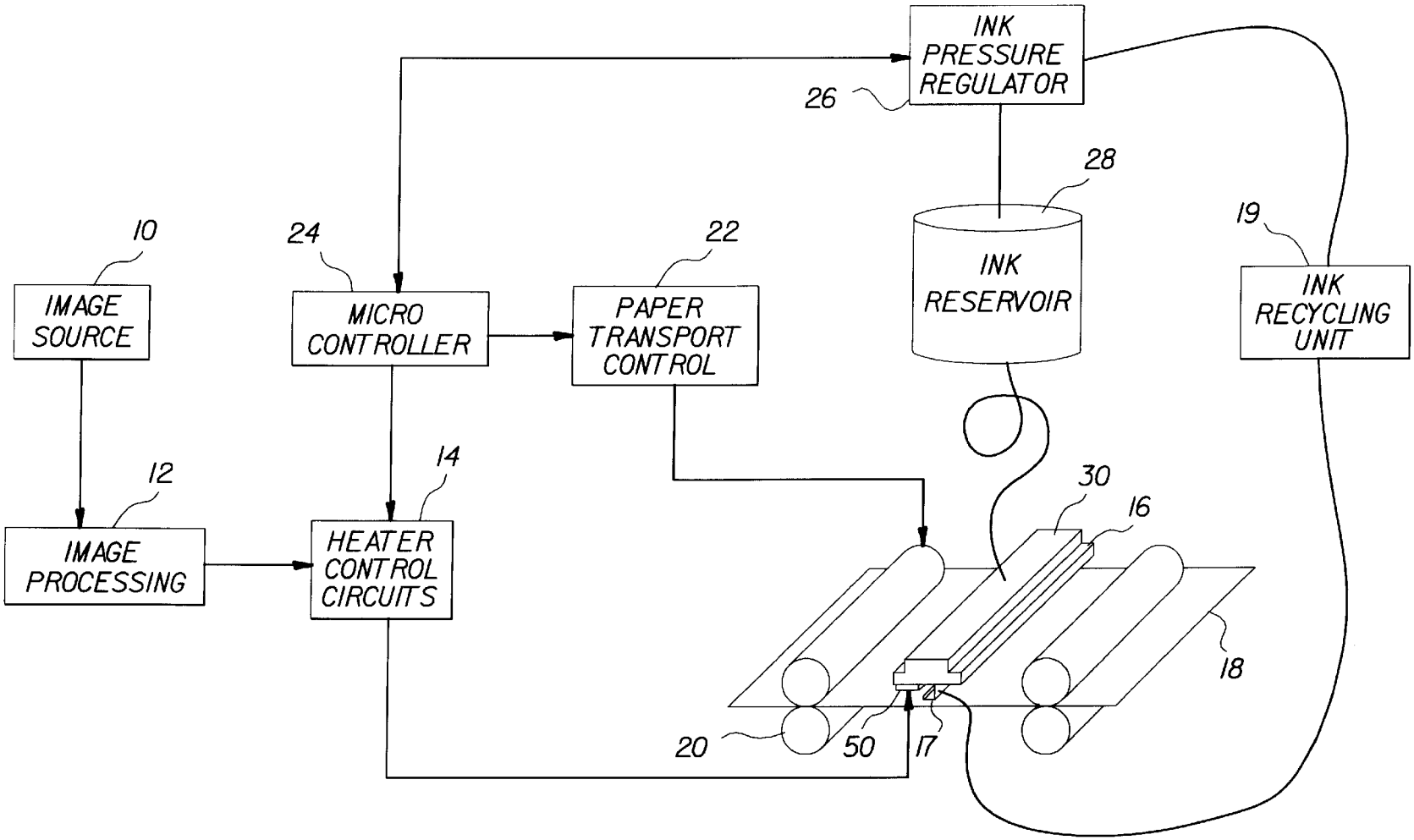
FIG. 1 shows a simplified block schematic diagram of one exemplary printing apparatus according to the present invention.

Referring to FIG. 1, a continuous ink jet printer system includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of heater control circuits 14 read data from the image memory and apply time-varying electrical pulses to a set of nozzle heaters 50 that are part of a print head 16. These pulses are applied at an appropriate time, and to the appropriate nozzle, so that drops formed from a continuous ink jet stream will form spots on a recording medium 18 in the appropriate position designated by the data in the image memory.

Recording medium 18 is moved relative to print head 16 by a recording medium transport system 20, which is electronically controlled by a recording medium transport control system 22, and which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width print heads, it is most convenient to move recording medium 18 past a stationary print head. However, in the case of scanning print systems, it is usually most convenient to move the print head along one axis (the sub-scanning direction) and the recording medium along an orthogonal axis (the main scanning direction) in a relative raster motion.

Ink is contained in an ink reservoir 28 under pressure. In the non-printing state, continuous ink jet drop streams are unable to reach recording medium 18 due to an ink gutter 17 that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of print head 16 by an ink channel device 30. The ink preferably flows through slots and/or holes etched through a silicon substrate of print head 16 to its front surface, where a plurality of nozzles and heaters are situated. With print head 16 fabricated from silicon, it is possible to integrate heater control circuits 14 with the print head.

Figure 2A:
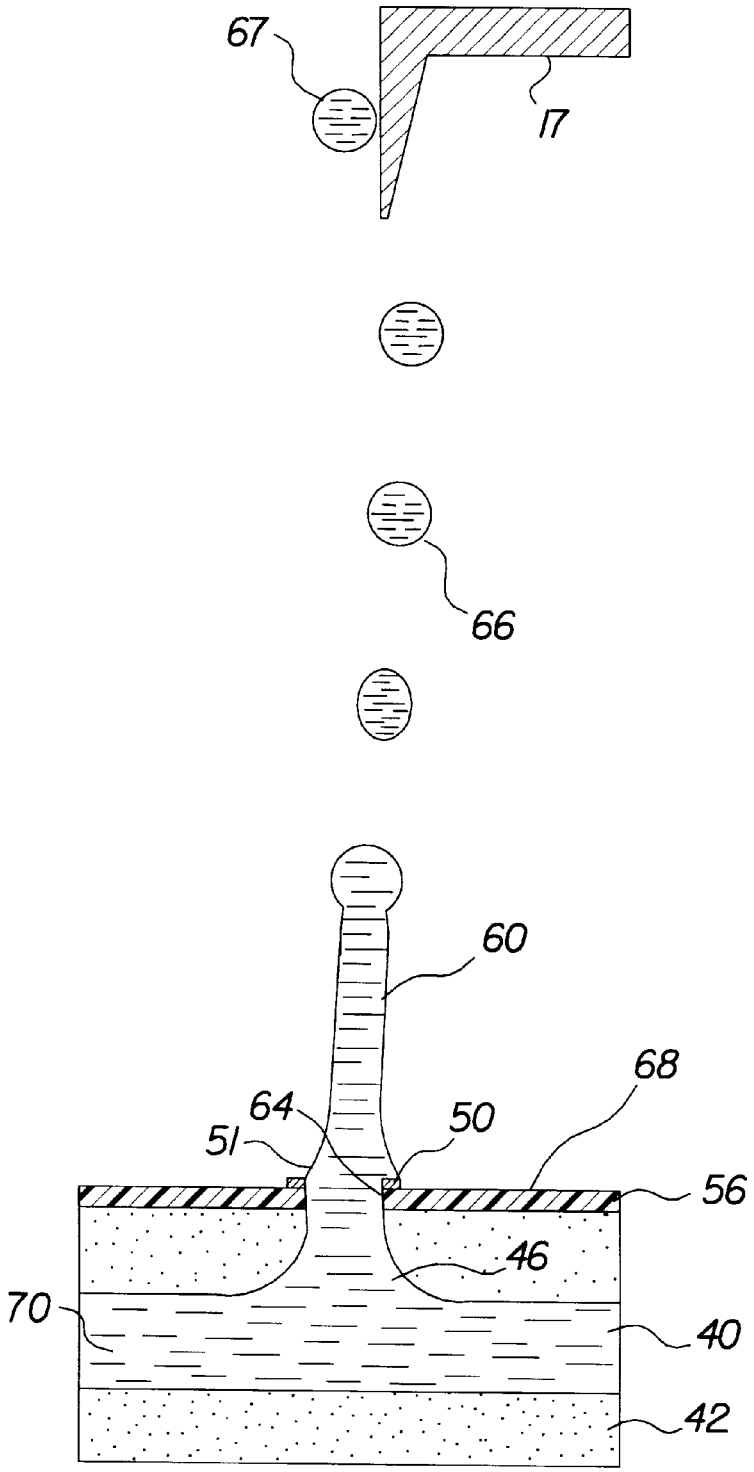
FIG. 2A shows a cross section of a nozzle with asymmetric heating deflection.

FIG. 2A is a cross-sectional view of one nozzle tip of an array of such tips that form continuous ink jet print head 16 of FIG. 1 according the above-cited co-pending application. An ink delivery channel 40, along with a plurality of nozzle bores 46 are etched in a substrate 42, which is silicon in this example. Delivery channel 40 and nozzle bores 46 may be formed by anisotropic wet etching of silicon, using a $p^+$ etch stop layer to form the nozzle bores. Ink 70 in delivery channel 40 is pressurized above atmospheric pressure, and forms a stream 60. At a distance above nozzle bore 46, stream 60 breaks into a plurality of drops 66 due to a heat periodic supplied by a pulse heater 50.

Figure 2B:
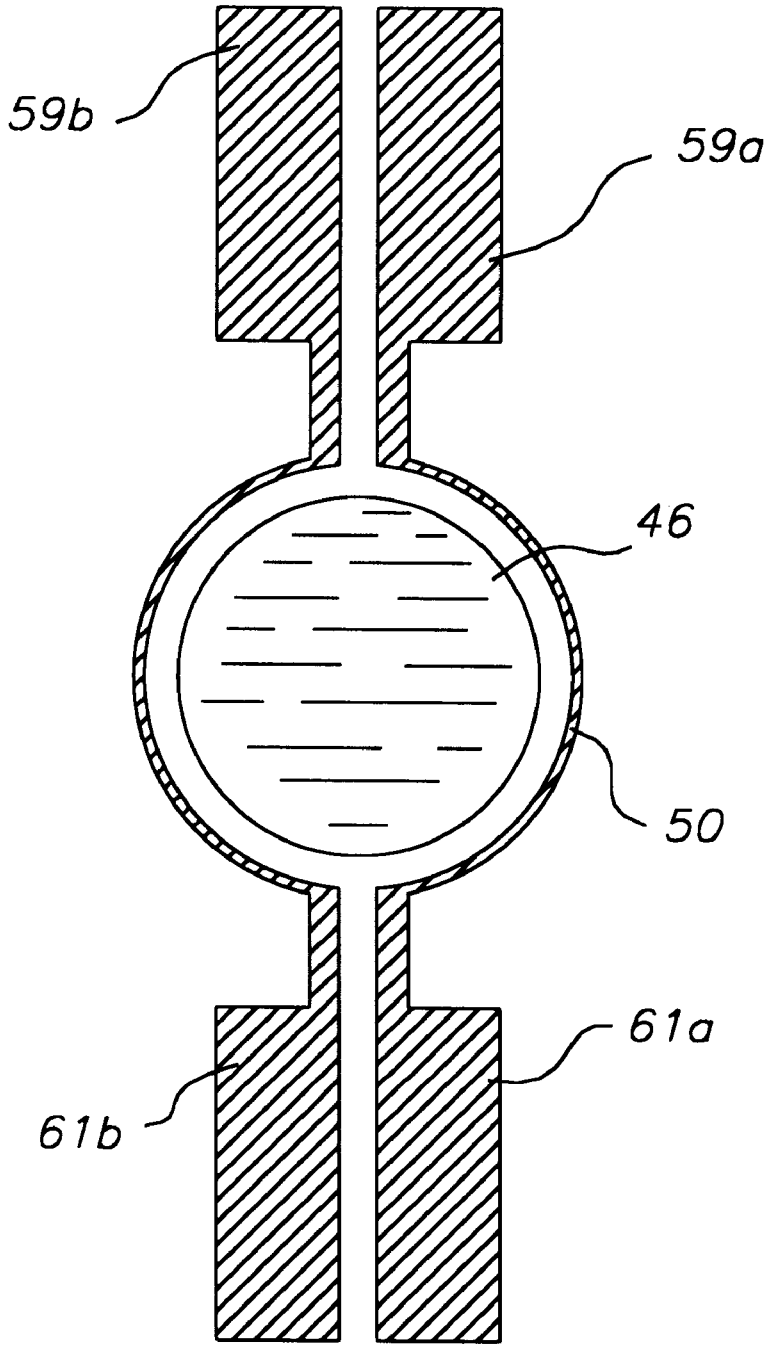
FIG. 2B shows a top view of the nozzle with asymmetric heating deflection.

Referring to FIG. 2B, the heater of the above-cited co-pending application has two sections, each covering approximately one-half of the nozzle perimeter. Power connections 59*a* and 59*b* and ground connections 61*a* and 61*b* from the drive circuitry to heater annulus 50 are also shown. Stream 60 may be deflected by an asymmetric application of heat by supplying electrical current to one, but not both, of the heater sections. With stream 60 being deflected, drops 66 may be blocked from reaching recording medium 18 by a cut-off device such as an ink gutter 17. In an alternate printing scheme, ink gutter 17 may be placed to block undeflected drops 67 so that deflected drops 66 will be allowed to reach recording medium 18.

The heater was made of polysilicon doped at a level of about thirty ohms/square, although other resistive heater material could be used. Heater 50 is separated from substrate 42 by thermal and electrical insulating layers 56 to minimize heat loss to the substrate. The nozzle bore may be etched allowing the nozzle exit orifice to be defined by insulating layers 56. The layers in contact with the ink can be passivated with a thin film layer 64 for protection. The print head surface can be coated with a hydrophobizing layer 68 to prevent accidental spread of the ink across the front of the print head.

Figure 3:
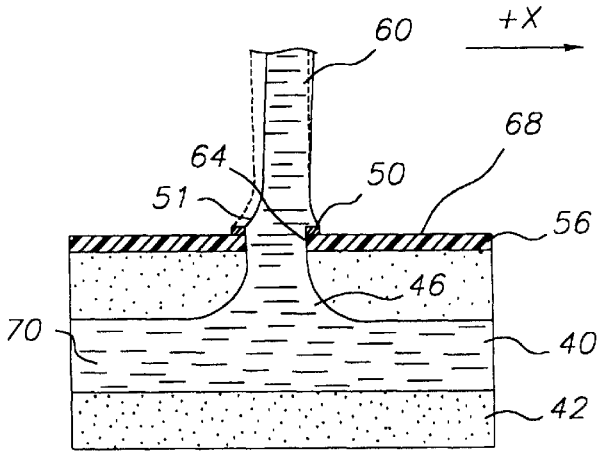
FIG. 3 is an enlarged cross section view of the nozzle with asymmetric heating deflection.

FIG. 3 is an enlarged view of the nozzle area of the above-cited co-pending application. A meniscus 51 is formed where the liquid stream makes contact with the heater edges. When an electrical pulse is supplied to one of the sections of heater 50 (the left-hand side in FIG. 3), the contact line that is initially on the outside edge of the heater (illustrated by the dotted line) is moved inwards toward the inside edge of the heater (illustrated by the solid line). The other side of the stream (the right-hand side in FIG. 3) stays pinned to the non-activated heater. The effect of the inward moving contact line is to deflect the stream in a direction away from the active heater section (left to right in FIG. 3 or in the +x direction). At some time after the electrical pulse ends the contact line returns toward the outside edge of the heater.

It is also possible to achieve drop deflection by employing a nozzle with a heater surrounding only one-half of the nozzle perimeter. The quiescent or non-deflected state utilizes pulses of sufficient amplitude to cause drop breakup, but not enough to cause significant deflection. When deflection is desired, a larger amplitude or longer width pulse is applied to the heater to cause a larger degree of asymmetric heating.

Parameters Affecting Angle of Deflection

Figure 4:
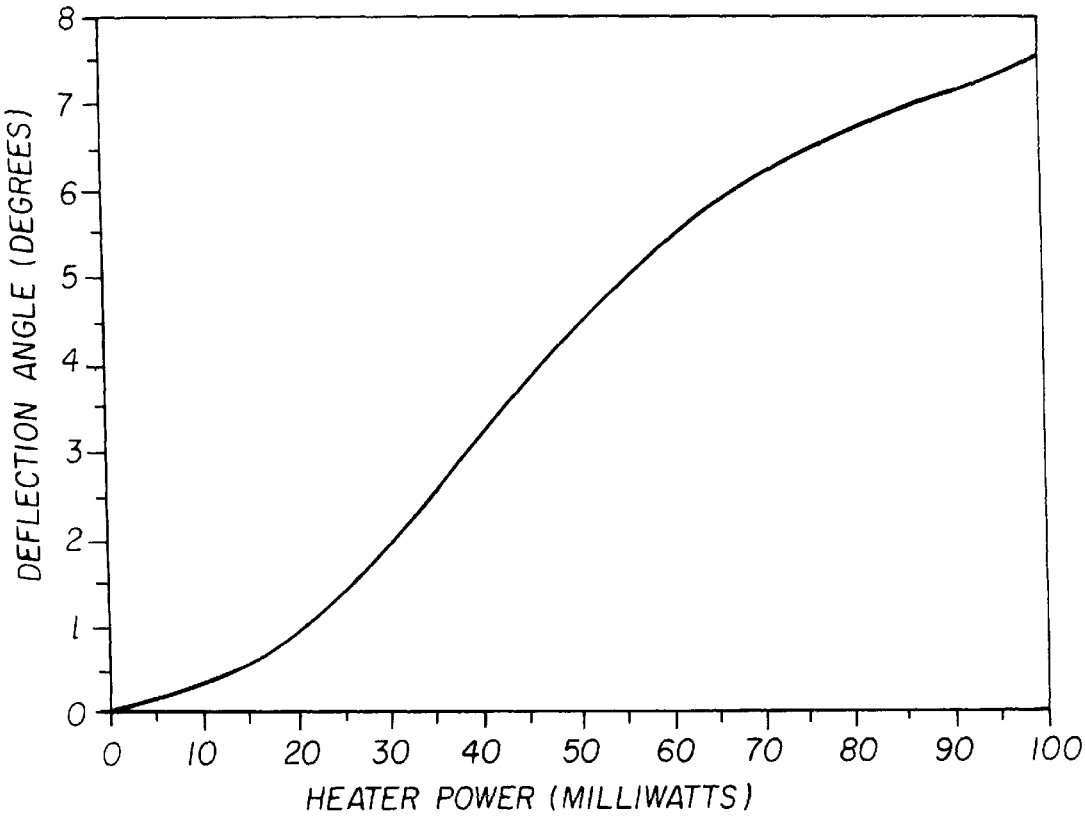
FIG. 4 is a graph showing that as the power applied at a heater is increased, the angle of deflection increases.

In studying the behavior of the nozzles described in the above-sited co-pending application, it was discovered that the angle of deflection of the stream or of the droplets could be varied by selectively adjusting the power applied to the heater. In FIG. 4, it is shown that the stream or droplet angle of deflection depends on the power input to the heater. As the power supplied to a section of the heater is increased, the angle of deflection increases, being fairly linear in the midrange of power. This phenomena can be used advantageously in continuous ink jet print heads of this type. Thus, if the heater is segmented and if the power to each segment can be independently adjusted, then fine adjustments to the positioning of the droplet can be made. In fact, droplet placement adjustments can be made dynamically using an automated scheme.

Figure 5A:
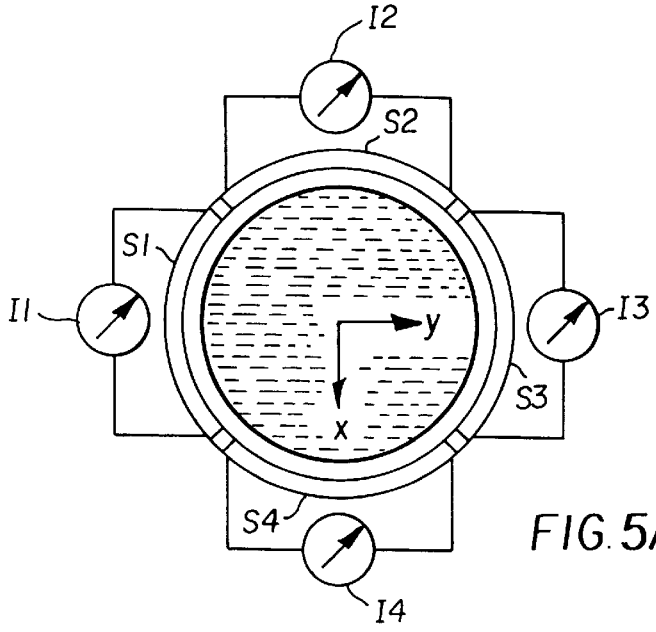
FIG. 5A is a view into the opening of a nozzle such that ink droplets come out of the page.
Figure 5B:
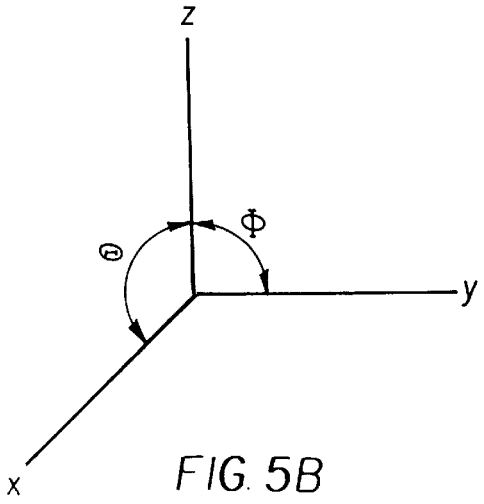
FIG. 5B is a graph defining angles of stream deflection.

Consider a heater with four equal length segments, as shown in FIG. 5A. Each segment S1 to S4 is connected to its own power supply 11–14, respectively. In FIG. 5A, the direction of the ink stream is out of the page, that is the z-direction of FIG. 5B. In FIG. 5B, the angle θ corresponds to droplet deflection in the x-z plane, and the angle Φ corresponds to droplet deflection in the y-z plane.

Figure 5C:
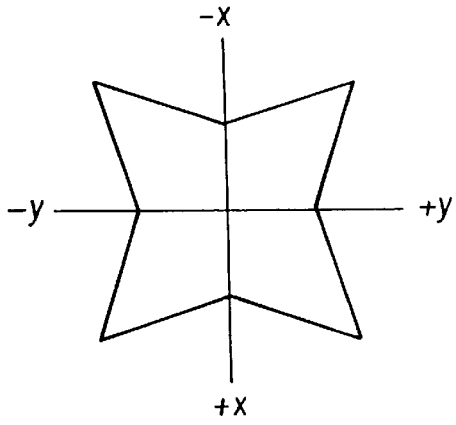
FIG. 5C is a graph showing a shape on a receiver within which droplets can be addressed.

In operation, maximum deflection is obtained if full power is provided to two adjacent segments. Thus if segments S1 and S2 are fully activated, the stream will be deflected the maximum amount along the 45° angle in +x and +y directions. Conversely, if segments S3 and S4 are powered, the stream will be deflected in the exact opposite direction. If only one segment is fully activated, however, the deflection will be along one of the major axis, but its magnitude will be less than if two segments had been fully activated. Thus a droplet can be placed anywhere within the area enclosed by the pattern shown in FIG. 5C. However, since the curve in FIG. 4 is not perfectly linear, some rounding of the corners of the pattern in FIG. 5C will occur. The exact deviation from linearity depends on the fabrication details of the nozzles. In an actual printing system, the presence of a gutter will shield some of the areas that could be printed.

Figure 6A:
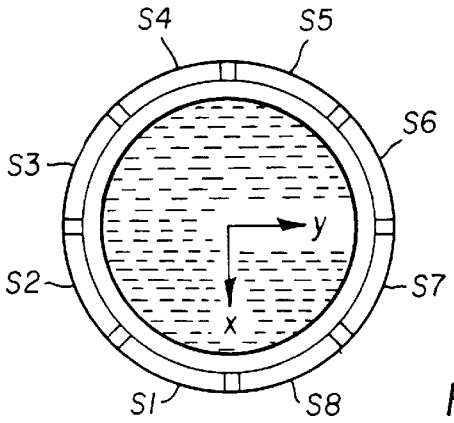
FIG. 6A is a view into the opening of a nozzle such that ink droplets come out of the page, similar to FIG. 5A.
Figure 6B:
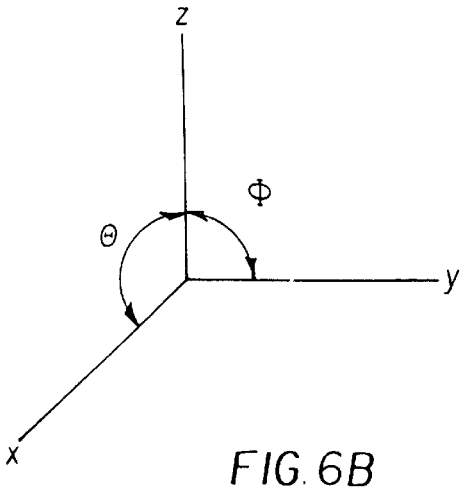
FIG. 6B is a graph defining angles of stream deflection, similar to FIG. 5B.
Figure 6C:
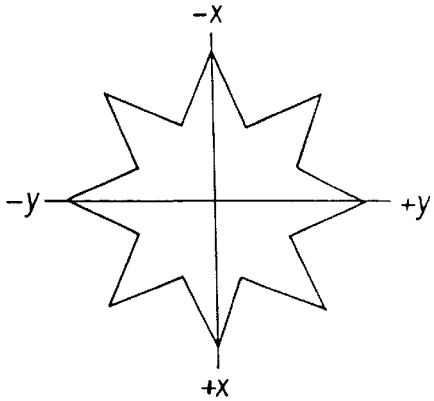
FIG. 6C is a graph showing a shape on a receiver within which droplets can be addressed, similar to FIG. 5C.

If a heater is broken up into eight segments, as shown in FIG. 6A, the pattern within which all points can be addressed is shown in FIG. 6C. In FIG. 6B, the angle θ corresponds to droplet deflection in the x-z plane, and the angle Φ corresponds to droplet deflection in the y-z plane. Compared to FIG. 5C more points are addressable. In the limit, if the heater is broken up into infinite segments, the pattern would be a circle, whose radius would be equal to the maximum deflection, which is obtained if half of the total heaters are activated with maximum power.

The invention has been described in detail with particular reference to preferred embodiments thereof, but it will be understood that variations and modifications can be effected within the spirit and scope of the invention.

What is claimed is:

1. Apparatus for controlling ink in a continuous ink jet printer in which a continuous stream of ink is emitted from a nozzle; said apparatus comprising:

an ink delivery channel;

a source of pressurized ink communicating with the ink delivery channel;

a nozzle bore perimeter defining a nozzle bore which opens into the ink delivery channel to establish a continuous flow of ink in a stream;

a heater having a plurality of selectively independently actuated sections which are positioned along respectively different portions of the nozzle bore perimeter;

a variable power source for the heater sections; and an actuator adapted to selectively activate none, one, or a plurality of said heater sections with an adjustable amount of power such that actuation of heater sections associated with only a portion of the entire nozzle bore perimeter produces an asymmetric application of heat to the stream to control the direction and the amount of deflection of the stream as a function of the amount of power of the activated heater sections wherein said actuator is further adapted to simultaneously actuate different numbers of heater sections which are associated with only a portion of the entire nozzle bore perimeter to produce corresponding different asymmetric application of heat to the stream.

2. Apparatus as set forth in claim 1, wherein the heater segments are of equal length.

3. Apparatus as set forth in claim 1, wherein each segment has its own associated power supply.

4. Apparatus as set forth in claim 1, wherein there are at least four heater segments.

5. Apparatus as set forth in claim 1, wherein there are four to eight heater segments.

6. Apparatus as set forth in claim 1, wherein there are at least eight heater segments.

7. Apparatus as set forth in claim 1, wherein substantially the entire bore perimeter is associated with a respective heater section.

8. A process for controlling ink in a continuous ink jet printer in which a continuous stream of ink is emitted from a nozzle bore having an annular heater with a plurality of selectively independently actuated sections positioned along respectively different portions of the nozzle bore; said process comprising:

establishing a continuous stream of ink from the nozzle bore;

selectively activating a plurality of said heater sections with an adjustable amount of power such that actuation of heater sections associated with only a portion of the entire nozzle bore produces an asymmetric application of heat to the stream to control the direction and the amount of deflection of the stream as a function of the amount of power of the activated heater sections.

* * * * *